US012350570B2

(12) United States Patent
Kaeding

(10) Patent No.: US 12,350,570 B2
(45) Date of Patent: Jul. 8, 2025

(54) SLACKLINE DEVICE

(71) Applicant: ID Sports GmbH, Stuttgart (DE)

(72) Inventor: Robert Kaeding, Stuttgart (DE)

(73) Assignee: ID SPORTS GMBH, Stuttgart (DE)

( * ) Notice: Subject to any disclaimer, the term of this patent is extended or adjusted under 35 U.S.C. 154(b) by 0 days.

(21) Appl. No.: 18/967,244

(22) Filed: Dec. 3, 2024

(65) Prior Publication Data

US 2025/0090885 A1 Mar. 20, 2025

Related U.S. Application Data

(63) Continuation of application No. 17/845,124, filed on Jun. 21, 2022, which is a continuation of application No. PCT/EP2022/051228, filed on Jan. 20, 2022.

(30) Foreign Application Priority Data

Jan. 20, 2021 (DE) ..... 20 2021 100 253.0

(51) Int. Cl.
*A63B 7/08* (2006.01)
*A63B 22/16* (2006.01)

(52) U.S. Cl.
CPC ..... *A63B 7/085* (2013.01); *A63B 22/16* (2013.01); *A63B 2208/0204* (2013.01)

(58) Field of Classification Search
CPC ..... A63B 22/16; A63B 22/18; A63B 22/0056; A63B 26/003; A63B 7/08; A63B 7/085
See application file for complete search history.

(56) References Cited

U.S. PATENT DOCUMENTS 3,083,964 A * 4/1963 Wentzel ..... A63H 33/00 482/34
9,764,175 B2 * 9/2017 Klopman ..... A63B 7/085
2008/0312043 A1 * 12/2008 Cook ..... A63B 26/003 482/34
2014/0329653 A1 * 11/2014 Klopman ..... A63B 26/003 482/143

(Continued)

FOREIGN PATENT DOCUMENTS

DE 2938364 A1 4/1981
DE 202009006948 A1 8/2009

(Continued)

OTHER PUBLICATIONS

International Search Report issued for PCT/EP2022/051228 on May 16, 2022; 13 pages.

(Continued)

*Primary Examiner* — Zachary T Moore
(74) *Attorney, Agent, or Firm* — Procopio, Cory, Hargreaves & Savitch LLP

(57) ABSTRACT

A slackline device comprising a main body having at least one bearing portion and two mutually opposite end portions which are disposed so as to be elevated in relation to the at least one bearing portion, and comprising a webbing which in an assembled state of the slackline device is tensioned between the two end portions of the main body. The slackline device is preferably portable. Strictly speaking, the slackline device disclosed herein is not a slackline in the actual sense, but is a device that is designed to realistically imitate the behavior of a slackline for the user.

20 Claims, 5 Drawing Sheets

(56) References Cited

U.S. PATENT DOCUMENTS

| | | | | |
|---|---|---|---|---|
| 2015/0157890 | A1* | 6/2015 | Klopman | A63B 7/085<br>482/142 |
| 2017/0291065 | A1* | 10/2017 | Klopman | G06F 3/013 |
| 2022/0314052 | A1* | 10/2022 | Kaeding | A63B 22/16 |

FOREIGN PATENT DOCUMENTS

| | | | | |
|---|---|---|---|---|
| DE | 102013000233 | A1 * | 7/2014 | A63B 22/16 |
| DE | 102013000233 | B4 * | 3/2021 | A63B 22/16 |
| JP | 2017023677 | A | 2/2017 | |

OTHER PUBLICATIONS

International Preliminary Report on Patentability issued for PCT/EP2022/051228 on Jul. 20, 2023; 5 pages.
Office Action issued by the Japanese Patent Office for JP2023-541900 on Jun. 4, 2024.
English Translation of Office Action issued by the Japanese Patent Office for JP2023-541900 on Jun. 4, 2024.

* cited by examiner

SLACKLINE DEVICE

CROSS REFERENCE TO RELATED APPLICATIONS

This application is a continuation of U.S. patent application Ser. No. 17/845,124, filed Jun. 21, 2022, entitled, "Slackline Device", which is a continuation of international patent application PCT/EP2022/051228, filed on Jan. 20, 2022, which claims priority from German utility model application DE 20 2021 100 253.0, filed on Jan. 20, 2021. The entire contents of these priority applications are incorporated herein by reference.

BACKGROUND

This disclosure relates to a slackline device. The disclosure relates in particular to a slackline device that is easy to assemble, transportable in a mobile manner, and to be used in a variety of applications.

Slackline devices are typically used for slacking or slacklining. This here is a trending sport which in the meantime has established itself as a leisure sport as well as in the high-performance and competitive sector. Slacking, which can be considered to be at least remotely similar to tightrope walking, can however also be used as a rehab measure for muscle building or balance training. Furthermore, various further potential applications of slackline devices of this type are conceivable, all of which are not listed for reasons of simplicity.

A slackline device typically comprises a webbing which is tensioned between two fastening points. This webbing is typically referred to as a slackline, this in the German language corresponding approximately to the term "slack rope" or slackline. The user balances himself/herself on this slackline, this-besides pure balance-requiring concentration and coordination.

As opposed to a tightrope or a highwire, as is used in the circus, for example, the webbing of the slackline device is in most instances a flat webbing which dynamically yields during use and thus requires special mitigating movements of the user. As opposed to a high wire, the slackline is thus not taut to the extent that said slackline barely moves. Instead, the slackline elongates under the load of the user, the latter typically also being referred to as a slackliner. The slackline behaves very dynamically and demands that the inherent movement of said slackline is actively counteracted at all times.

In the most specific applications known to date, the webbing (the slackline) is tensioned between two trees or other fixedly anchored points in the landscape. In the absence of natural anchoring points such as trees, rocks etc., free-standing scaffolds which are in most instances configured from steel can also serve as anchoring points for the webbing of the slackline device.

In order to enable the dynamic properties described, it is most typically necessary for the webbing to be tensioned across a length of several meters. In most instances, the distance between the two fastening points of the webbing is 10 m or more. Depending on the specific application, slacklines of this type are sometimes also tensioned across more than 30 m, 40 m, or even across several 100 m. Slackline devices of this type correspondingly require a relatively large amount of space.

While a space-saving design of the slackline device would be advantageous with a view to various specific applications, this has not been able to be implemented in an expedient manner to date. In the case of the slackline being suspended between two points that are very close to one another the dynamic properties of the slackline would no longer be provided. A design of the webbing which is more elastic than is typically the case would indeed ensure certain dynamics but would significantly change the extremely dynamic movement behavior, which is a characteristic of the slackline.

SUMMARY

It is an object to provide a slackline device which is of a comparatively compact construction, is able to be transported in a mobile manner, and can be assembled in a relatively simple manner. Despite the compact design, the slackline device shall nevertheless provide the user with the movement behavior typical of slacklines, or at least approximately imitate this movement behavior.

According to a first aspect, a slackline device is provided, which comprises a main body having at least one bearing portion and two mutually opposite end portions which are disposed so as to be elevated in relation to the at least one bearing portion, and which comprises a webbing which in the assembled state of the slackline device is tensioned between the two end portions of the main body, wherein the slackline device is characterized in that the main body is configured to be more elastic than the webbing.

The property pertaining to the fact that the main body is configured to be more elastic than the webbing presently means that the main body overall is more elastic than the webbing overall. It is compulsory neither for the main body nor the webbing to have a linear elastic behavior. In practice, this will at least often not be the case.

The more elastic design of the main body in comparison to the webbing has the effect that the main body in the event of tension exerted on the slackline device is more strongly deformed than the webbing.

As opposed to conventional slackline devices, the dynamic properties in the presented slackline device are thus not caused by the elongation or longitudinal variation of the webbing under load, but substantially by a load-dependent variation of the shape of the main body. As a result, it is possible for the slackline device to be configured to be comparatively small and compact.

The webbing in such a case is indeed correspondingly short, which is why said webbing barely varies in terms of the length thereof due to tension or elongation when customary slackline materials are used. However, the required longitudinal variation is caused by a variation in the shape of the main body, and thus a variation in the distance of the two fastening points of the webbing. In other words, the main body is deformed under load so that the two mutually opposite end portions of the main body dynamically vary the mutual distance thereof, the webbing being tensioned between said two mutually opposite end portions.

The latter is a substantial difference in comparison to conventional slackline devices in which the distance between the two fastening points of the webbing is typically fixed, or is at least not appreciably varied. This is easy to comprehend in particular in cases where a steel construction is used as a support for the webbing, or the webbing is suspended between two trees or two rocks.

Strictly speaking, the slackline device is thus not a slackline in the actual sense but a device which by way of a somewhat different type of design nevertheless very realistically imitates the behavior of a slackline for the user. The term "slackline device" is therefore to be understood here to be relatively broad and is not limited to special materials or shapes of the main body and the webbing. The slackline device is also not limited to the specific applications already known.

It is furthermore to be noted that the bearing portion of the main body may be configured in various ways. This bearing portion serves for setting up the device on hard ground. In principle, different portions of the main body can serve for setting up the slackline device on the hard ground. A plurality of bearing portions can be provided. It is likewise possible that these bearing portions, by way of which the slackline device bears on the hard ground, vary as a result of the movement of the main body in relation to the hard ground during the use of the slackline device. Therefore, the wording "at least one bearing portion" is used herein.

According to a refinement, an elasticity modulus of the webbing is higher than an elasticity modulus of the main body. The elasticity modulus of the webbing is preferably at least two times, at least five times, or even at least ten times, higher than the elasticity modulus of the main body.

It has been demonstrated that the above-mentioned movement behavior of the slackline device can be best implemented in this way. As mentioned, the movement behavior is substantially caused by the deformation of the main body as a result.

According to a further refinement, the main body is configured as a board. This board is preferably a wooden board made from wood veneer.

The dynamic properties can be implemented in a cost-effective manner as a result of this type of design. Moreover, the slackline device having the main body configured as a board can be configured as a comparatively lightweight device which can readily be carried by hand.

According to a further refinement, the bearing portion is disposed between the two end portions and is integrally connected thereto.

In this way, the slackline device is simply constructed from ideally few parts.

According to a further refinement, the two end portions are in each case configured as ends or tips of the main body that are curved upward in relation to the bearing portion. The main body, or the board, is preferably continually curved at the transitions between the at least one bearing portion and the end portions.

The main body thus has a shape similar to that of the board of a skateboard. In addition to the customary balancing exercises which can be performed with slackline devices, the slackline device, similar to a skateboard, can thus be additionally tilted order rotated about one axis or a plurality of axes. As a result, the user is not only provided with a completely new experience, but at the same time this also makes possible various further types of application and use of the slackline device compared with conventional slackline devices. Both the webbing and also the main body or the board are able to move in virtually any conceivable way in relation to the hard ground.

According to a further refinement, it is provided that a distance between the two end portions is smaller than 2.5 m or smaller than 2 m or even smaller than 1.5 m.

The slackline device is thus configured to be very compact and manageable. By virtue of the elastic properties of the main body mentioned above, it is even possible for the distance between the two suspension points of the webbing, thus the distance between the two end portions of the main body, to be decreased to less than 1 m without the movement behavior required for slacking being lost.

According to a further refinement, it is provided that a width of the main body is smaller than a distance, measured orthogonally to said width, between the two end portions.

According to a further refinement, the main body in a longitudinal section has a concave-convex profile, a rocker profile and/or a cambered profile.

Different dynamic movement behavior of the main body and static bearing properties of the main body on the hard ground are derived as a function of the longitudinal sectional profile of the main body.

It is understood that the stated longitudinal sectional profiles can also be combined with one another, in a manner similar to how this may also be the case with skateboards, snowboards and skis.

According to a further refinement, the webbing is releasably connected to at least one of the two end portions of the main body.

Therefore, the slackline device does not have to be shipped in a pre-assembled state but can be assembled by the user himself/herself at any time and be disassembled again after use.

As in customary slackline devices, the webbing is preferably configured as a flat webbing, the cross-sectional width thereof preferably being 10 to 60 mm, and the cross-sectional height thereof, measured orthogonally to the width, being at most half the cross-sectional width.

The webbing may comprise at least one of the following materials, which can also be combined with one another: polyester, polyamide, braided yarn or hemp.

According to a further refinement, the slackline device furthermore comprises a second webbing which in the assembled state of the slackline device is tensioned between the two end portions of the main body, wherein the two webbings are disposed so as to be mutually parallel.

This refinement also enables further exercises and specific applications of the slackline device without requiring a comparatively high complexity in terms of assembling. The two webbings are each preferably releasably attachable to the main body so that the user of the slackline device according to the present application can use the latter with only one or else optionally with two webbings.

Of course, it is possible for the slackline device to be configured in such a manner that said slackline device can be used with more than two webbings.

According to a second aspect, a slackline device is provided, which comprises a main body having at least one bearing portion and two mutually opposite end portions which are disposed so as to be elevated in relation to the at least one bearing portion, and which comprises a webbing which in the assembled state of the slackline device is tensioned between the two end portions of the main body, wherein the slackline device according to this aspect is characterized in that a first one of the two end portions comprises a first planar end portion having a first slot penetrating the main body, the webbing in the assembled state of the slackline device being guided through said first slot by way of a first loop formed by folding back a first end of the webbing, wherein a first locking element is guided through the first loop, said first locking element by way of the two end pieces thereof that are mutually opposite in the longitudinal direction of the first locking element bearing on the first planar wall portion on opposite sides of the first slot.

This aspect relates in particular to a type of attachment and assembly of the webbing on the main body of the slackline device that is a relatively easy to implement. The webbing by way of ideally few components can be very easily assembled on the main body and pretensioned to the desired tension by hand.

By folding back or folding over the first end of the webbing so as to form said first loop, the webbing in this region lies on top of itself and friction or resistance consequently arises, depending on the direction. When interacting with the locking element this creates a mechanism which acts as a locking or fixing mechanism when the webbing is under tension. However, when pulling on the end of the first loop, the mechanism does not lock and permits excessive webbing material to be extracted. The webbing can thus be tensioned by hand in an ideally simple manner.

When more force is applied during the tensioning procedure, the main body by virtue of the elastic properties thereof described above begins to bend in an arcuate manner. As a result, the distance between the suspension points of the webbing at the two mutually opposite end portions of the main body is shortened so that the webbing is consequently loosened. In this way, even more webbing material can be pulled through the first slot and the webbing can be firmly pretensioned.

According to a refinement, it is provided that a second loop is fixedly disposed on the first end of the webbing, said second loop in the assembled state of the slackline device not being guided through the first slot and being disposed below the remainder of the webbing, thus between the remainder of the webbing and the main body.

A pin or any other ancillary means, with the aid of which a tensile force can be exerted on the webbing so as to be able to pretension said webbing by hand during the assembly procedure mentioned above, can be guided through this second loop disposed on the first end of the webbing, for example. The ergonomics of the tensioning procedure are significantly simplified as a result.

The second loop is presently referred to as "fixedly disposed", this being intended to clarify that the second loop is a fixedly assembled loop which, as opposed to the first loop, is not just created by folding back or folding over the webbing.

According to a further refinement, it is provided that the first locking element comprises a centerpiece which is of a substantially cylindrical design and disposed between the two end pieces which likewise are in each case of a substantially cylindrical design and have a diameter that is enlarged in relation to the centerpiece.

This results in each case in a type of roller being created on the two end pieces of the locking element, said rollers during the tensioning of the webbing being able to roll on the planar wall portions disposed on both end portions of the main body. This simplifies the tensioning procedure of the webbing because it is also guaranteed as a result of this shaping that the webbing in the tensioned state is not jammed between the first locking element and the first slot.

According to a further refinement, it is provided that a second one of the two end portions comprises a second planar wall portion having a second slot penetrating the main body, the webbing in the assembled state of the slackline device being guided through said second slot by way of a third loop which is fixedly disposed on a second end of the webbing, wherein a securing element is guided through the third loop.

The securing element is preferably configured as a securing pin which, in a manner similar to that of the first locking element, is guided through the third loop. In this way, the webbing preferably comprises two fixedly disposed loops which are presently referred to as second and third loops. Accordingly, the webbing can be releasably connected to both end portions of the main body so that said webbing is also able to be completely disassembled from the main body after the use of the slackline device.

It is understood that the features mentioned above and yet to be explained hereunder can be used not only in the respective combination stated but also in other combinations and individually without departing from the spirit and scope of the present disclosure. It is furthermore understood that the optional refinements mentioned above relate not only to the slackline device according to the first aspect but in an identical or equivalent manner also to the slackline device according to the second aspect.

BRIEF DESCRIPTION OF THE DRAWINGS

Further advantages and embodiments of the application are disclosed in the description and attached drawings. In the drawings.

DESCRIPTION OF PREFERRED EMBODIMENTS

Figure 1:
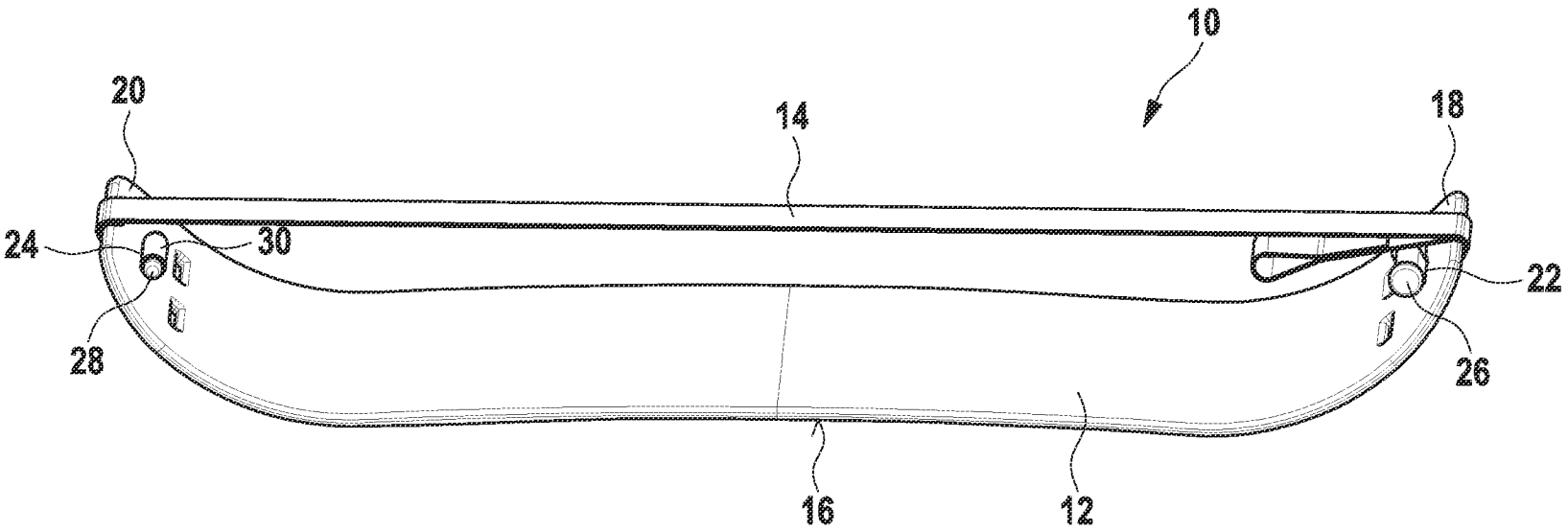
FIG. 1 shows a perspective view of a slackline device according to an embodiment.

FIGS. 1 to 7 show a plurality of embodiments of a slackline device. The slackline device in its entirety therein is in each case identified by the reference sign 10.

The slackline device 10 comprises a main body 12 and a webbing 14 which is able to be fastened to the main body 12. As will yet be explained in more detail hereunder, the webbing 14 is releasably disposed on the main body 12.

The main body 12 according to the presently shown embodiment is configured as a board which in terms of the shape is similar to a skateboard or a snowboard. The dimensions of this board are also fundamentally similar to the dimensions of a skateboard or snowboard, this not being intended to imply any kind of restriction.

The main body 12 configured as a board is preferably constructed from a wood veneer. In principle, however, synthetic materials can also be considered for use as the basic material for the main body 12.

The webbing 14 is preferably a flat webbing as is also used already in conventional slackline devices. The webbing 14 can be produced from, for example, polyester, polyamide, braided yarn and/or hemp. Of course, further materials are also conceivable here.

The main body 12 comprises a bearing portion 16 and two end portions 18, 20 which are disposed so as to be mutually opposite and form the two longitudinal ends of the main body 12. The end portions 18, 20, which presently are referred to as the first end portion 18 and the second end portion 20, in the exemplary body shown are configured as ends that are curved upward. The two end portions 18, 20 are integrally connected to the bearing portion 16 and disposed so as to be elevated in relation to the latter.

In this case the lower side of the main body 12 serves as the bearing portion 16. Depending on the shape or the longitudinal sectional profile of the main body 12, one or a plurality of bearing portions 16 may be provided. This means that the main body 12 on the lower side thereof bears on the hard ground at one or a plurality of locations. Of course, these locations may vary during the use of the slackline device 10. In principle, it would be likewise conceivable for further bearing elements to be attached to the lower side of the main body 12, said further bearing elements in this instance forming the at least one bearing portion 16.

The transition between the central or bearing portion 16 and the two end portions 18, 20 is in each case preferably configured as a continuously curved, arcuate transition. In principle however, it would also be possible for a kink to be provided here. However, an arcuate curvature has the advantage that the main body 12, and thus also the entire slackline device 10, can be moved more easily and continuously. In this way, it is possible for the user to have more degrees of freedom and thus a more diverse use of the slackline device 10.

In the presently shown embodiment the webbing 14 is releasably disposed on both end portions 18, 20. To this end, a first slot 22 is provided on the first end portion 18, and a second slot 24 is provided on the second end portion 20. Both slots 22, 24 preferably penetrate the main body 12 completely.

Furthermore, a locking element 26 and a securing element 28 are used for assembling the webbing 14. No further components are otherwise required for assembling the slackline device 10. The manner and the procedure of the assembly will yet be explained in detail hereunder.

Figure 2A:
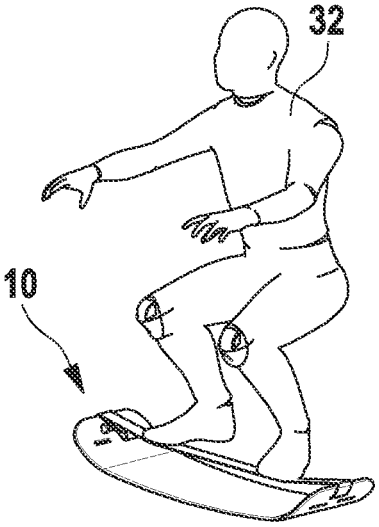
FIGS. 2*a*-2*c* show a plurality of views that in a schematic manner visualize the use of the slackline device.
Figure 2C:
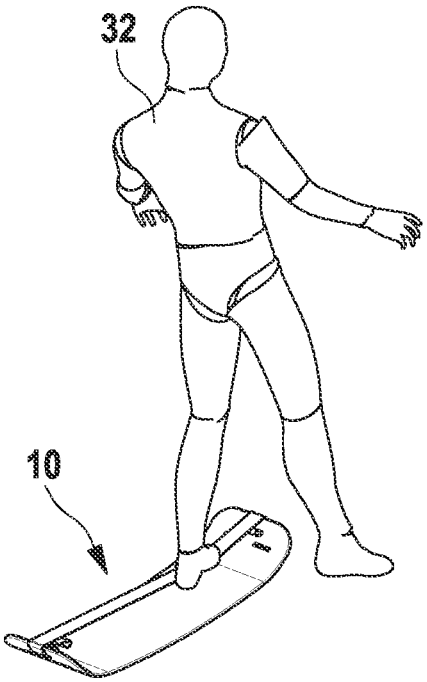
Figure 2B:
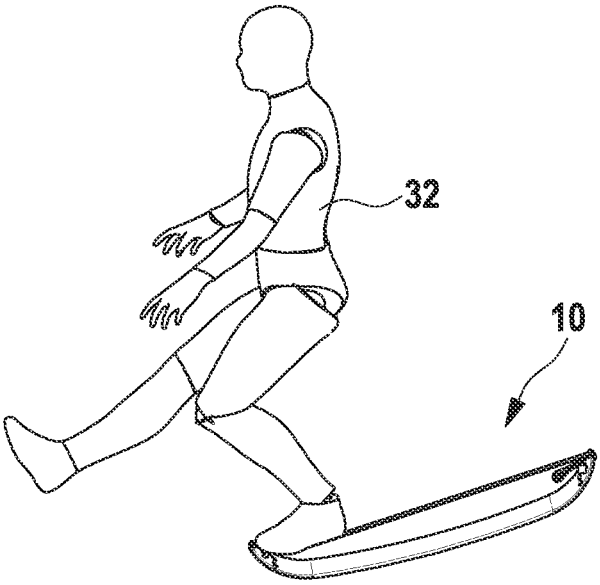

FIGS. 2*a*-2*c* show a plurality of views which schematically visualize the intended use of the slackline device 10. It is to be pointed out that the types of use shown herein illustrate only three exemplary uses of various potential uses of the slackline device 10. Apart from the fundamental possibility to balance on the webbing 14 on one foot or both feet, the user 32 can additionally also tilt the main body or the board 12 or rotate it in any desired manner similar to that also possible with a skateboard.

The main body 12 is configured to be more elastic than the webbing 14. As a result, with the slackline device 10 it is possible to simulate or imitate webbing 14 behavior similar to that arising in conventional slackline devices. This is made specifically possible despite the fact that the webbing 14 of the slackline device 10 is typically configured to be substantially shorter than a conventional slackline device.

As a result of the property of the main body 12 being configured to be more elastic than the webbing 14, the main body 12 in the loaded state yields more than the webbing 14. The main body or the board 12 bends in the loaded state. In other words, the bearing portion 16 and/or the end portions 18, 20 flex/flexes in such a manner that the distance between the two fastening points of the webbing 14, or the distance between the two slots 22, 24, varies dynamically. This variation of the distance results in a variation of the tension or elongation of the webbing 14. This variation of the tension or elongation of the webbing 14 is thus not primarily caused by an elongation of the webbing 14 per se, or by a longitudinal variation of the latter, but primarily by a variation of the distance of the suspension points of the webbing 14 on the main body 12.

Of course, a longitudinal variation of the webbing 14 per se also arises in the loaded state. In comparison to the variation of the distance of the suspension points of the webbing 14 however, said longitudinal variation is negligible because the elasticity modulus of the webbing is considerably higher than the elasticity modulus of the main body.

Figure 3:
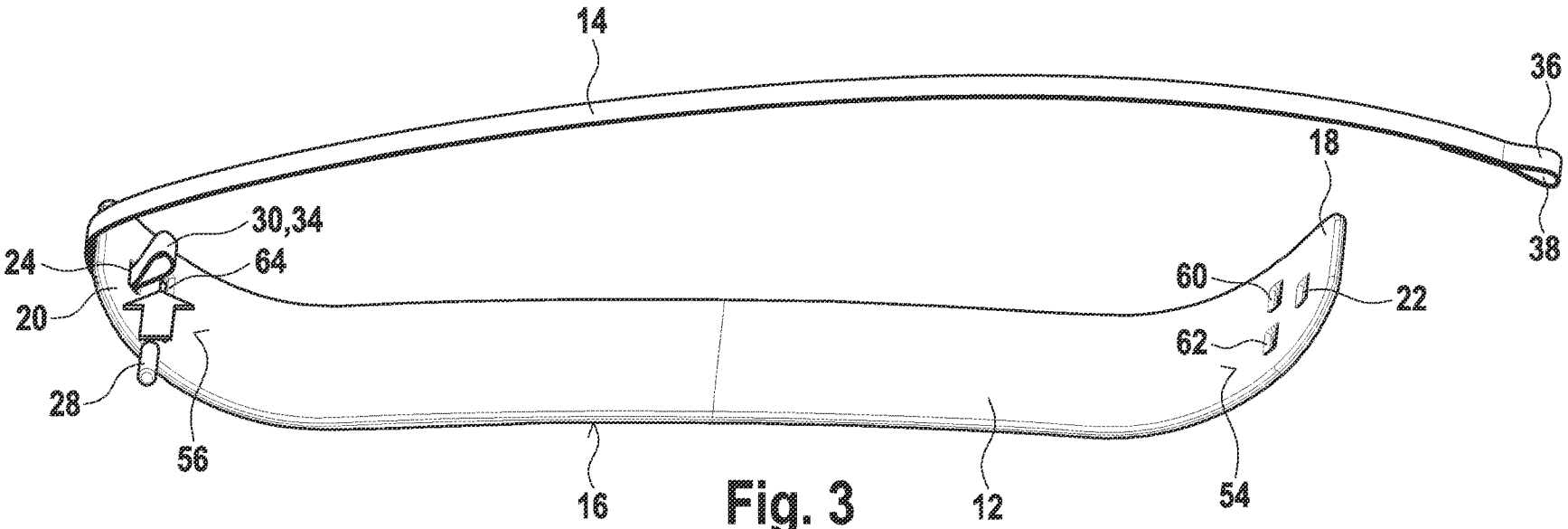
FIG. 3 shows the slackline device from FIG. 1 in a first state, during assembly.
Figure 4:
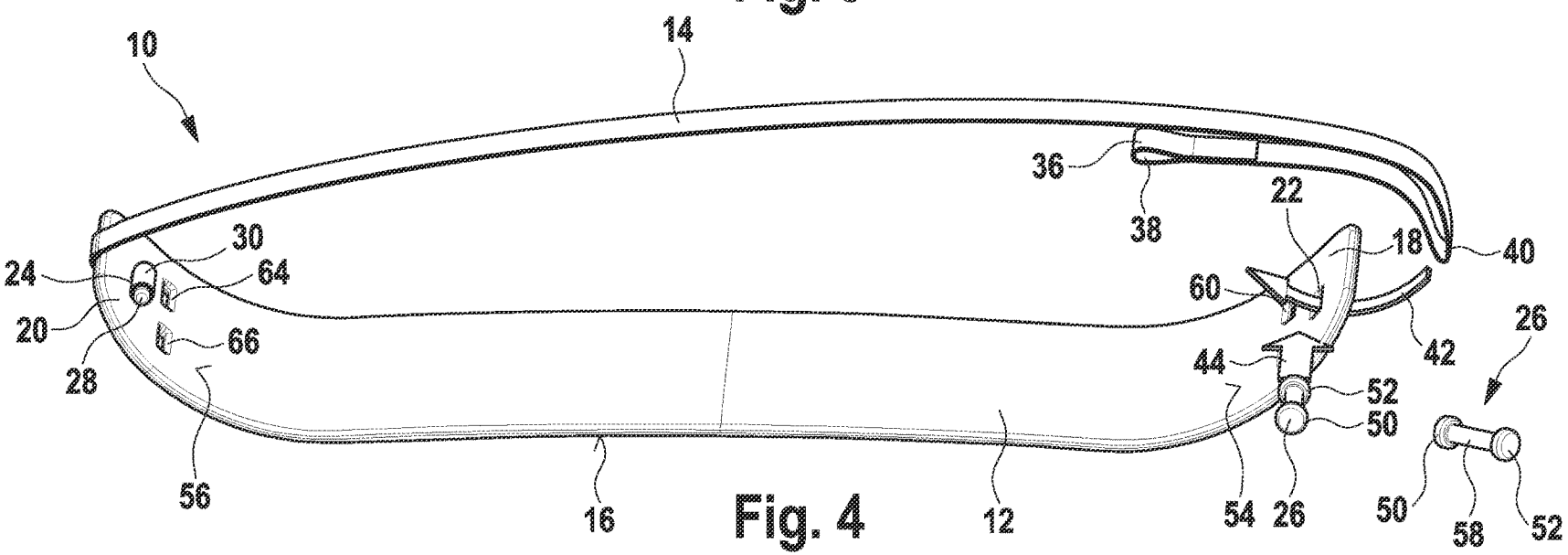
FIG. 4 shows the slackline device from FIG. 1 in a second state, during assembly.
Figure 5:
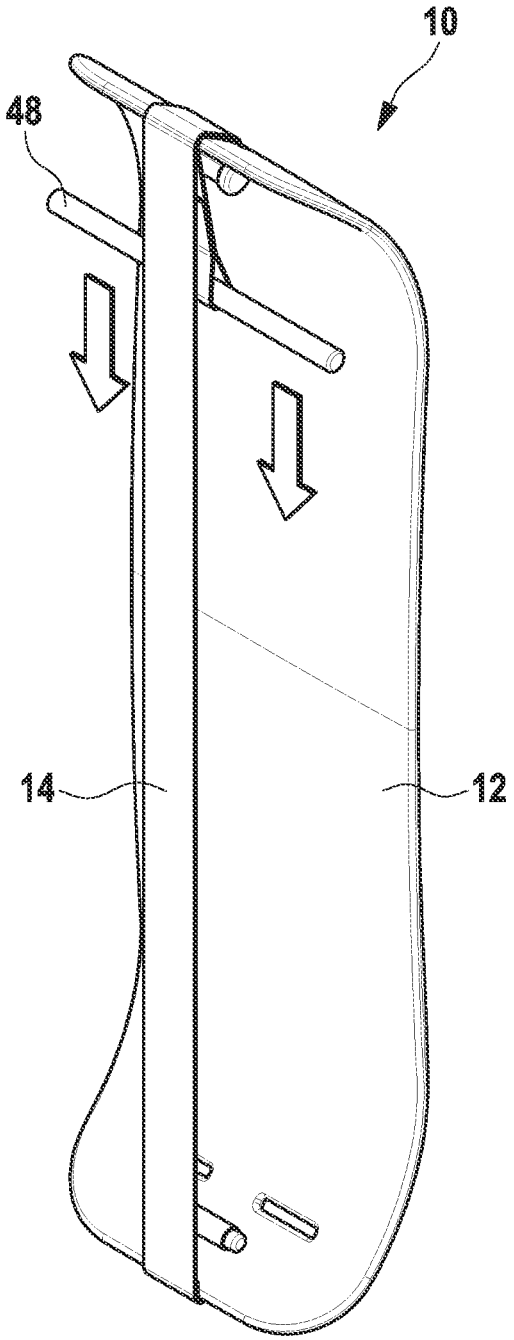
FIG. 5 shows a detail of the slackline device from FIG. 1 in a third state, during assembly.

The assembly of the webbing 14 on the main body 12 is visualized in the sequence of individual steps in FIGS. 3 to 5. First, an end 30 of the webbing 14, which presently is referred to as the second end, is guided from the outside through the second slot 24 and with the aid of a securing element 28 fixed on the main body 12. The securing element 28 is configured as a pin which is introduced into a loop 34 provided on the second end 30 of the webbing 14. A loop 38 is likewise provided on the opposite first end 36 of the webbing 14. Both loops 34, 38 are fixedly disposed loops which are fixed by stitching or adhesive bonding, for example.

In the next step, the first end 36 including the loop 38 which is provided thereon is folded back, as is schematically shown in FIG. 4. A further (mobile) loop 40 is created as a result of this folding action. The webbing 14 by way of this folded loop 40 is pushed from the outside through the first slot 22 (see arrow 42). A locking element 26 is subsequently introduced into the loop 40, as is schematically illustrated by the arrow 44 in FIG. 4. The webbing 14 is then tautened at the first end 36 thereof. To this end, a rod-shaped ancillary means 48 can be introduced into the loop 38 disposed on the first end 36 of the webbing 14, for example, so as to then pull firmly on the webbing 14 (see FIG. 5). When correctly assembled, this loop 38 in the state shown in FIG. 5 is disposed below the webbing 14, thus between the webbing 14 and the main body 12.

As a result of the folding action shown in FIG. 4, which leads to the loop 40 being formed, the webbing 14 lies on top of itself and friction or resistance consequently arises, depending on the direction. The fastening mechanism described blocks or fixes the webbing 14 on the main body 12 when tension is exerted on the webbing. However, the mechanism does not lock when pulling takes place on the first end 36 of the webbing 14, this allowing excess webbing material 14 to be extracted.

When more force is exerted during the tensioning procedure, the main body 12 per se, by virtue of the predefined shape and material properties thereof, begins to bend so as to form an arc. As a result, the distance between the two end portions 18, 20 of the main body 12 is decreased and the webbing 14 is consequently also loosened. This loosening is simultaneously compensated for by the tensile force exerted on the first end 36 of the webbing 14. As a result, the webbing 14 can be very easily tightened by hand.

The locking element 26 functions as an arrester. This locking element 26, by way of the mutually opposite end pieces 50, 52 (see FIG. 4), bears on the first end portion 18 on the planar wall portion 54 formed on the inside on opposite sides of the first slot 22 on the main body 12. In a similar manner, at the opposite end, the second end 30 of the webbing 14, the securing pin 28 on opposite sides of the second slot 24 also bears on a planar wall portion 56 formed on the second end 20 of the main body 12.

In order to prevent that the webbing 14 in the tensioned state on the wrapping about the locking element 26 jams on the main body 12, the locking element 26 preferably has the following shape which can be seen in particular in the view in FIG. 4. The locking element 26, beside the two end pieces 50, 52 thereof disposed on both end sides, comprises a centerpiece 58 which integrally connects the two end pieces 50, 52. This centerpiece 58, as also the two end pieces 50, 52, is preferably configured to be substantially cylindrical. However, the two end pieces 50, 52 have a diameter which is enlarged in comparison to the centerpiece 58. A type of roller effect is created as a result, on account of which the locking element 26 rolls on the planar wall portion 54 while the webbing 14 is being tensioned. As a result, jamming of the webbing 14 between the locking element 26 and the slot 22 is largely precluded.

Figure 6:
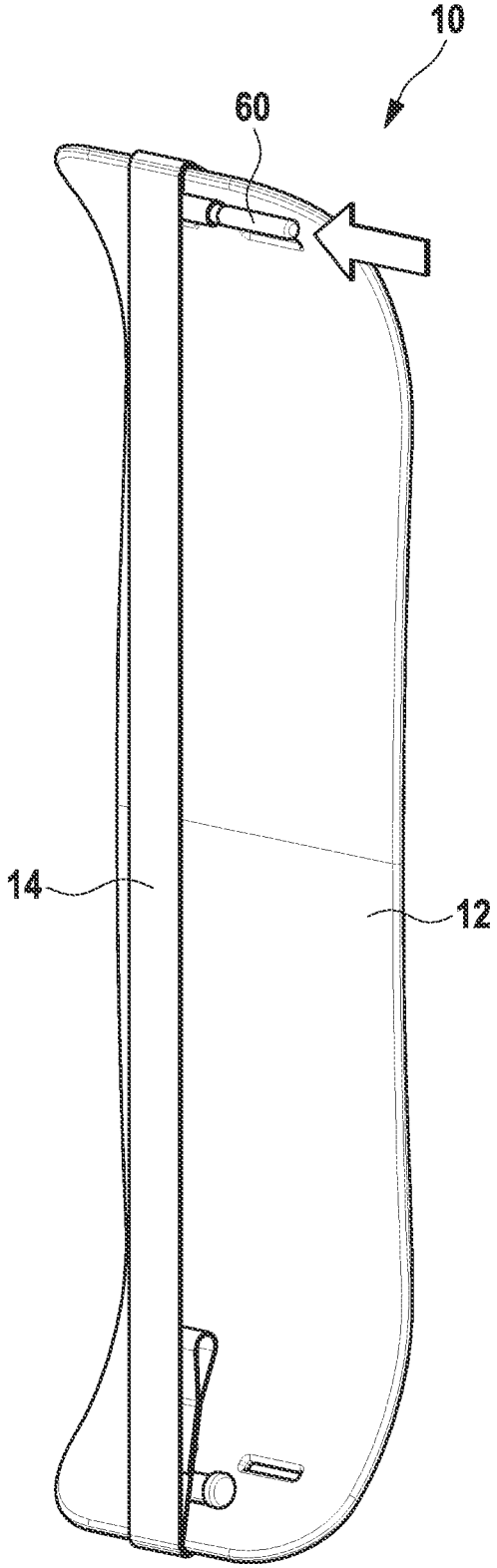
FIG. 6 shows a detail of the slackline device from FIG. 1 in a state during disassembly.
Figure 7A:
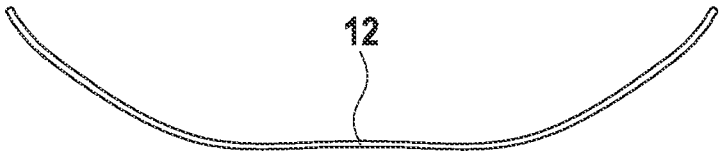
FIGS. 7*a*-7*d* show a plurality of schematic profiles of a main body of the slackline device according to further embodiments.
Figure 7B:
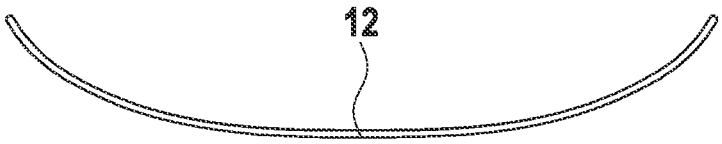
Figure 7C:
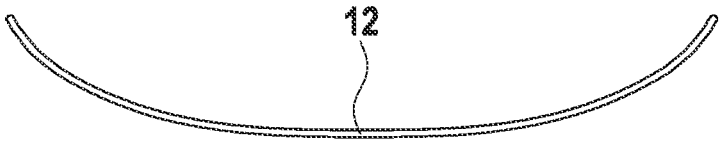
Figure 7D:
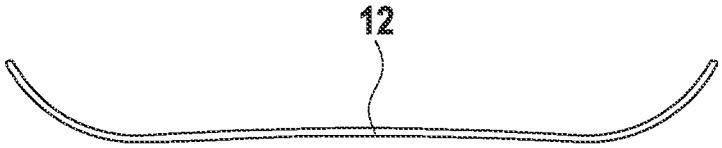

In order for the slackline device 10 to be disassembled, or for the webbing 14 to be released, it is only necessary for the securing element 28 to be removed. This can take place, for example, by releasing the securing element 28 with a hammer and a further pin 60, as is schematically indicated in FIG. 6.

In summary, a device which is very easy to assemble and disassemble and can be used in a diverse manner by the user is created in this way. The slackline device 10 is configured to be portable and can be very manageably transported almost anywhere and used in the smallest space. Nevertheless, said slackline device 10 also offers the user the option of acting like a conventional slackline device, should this be desired.

Furthermore, it is possible for the slackline device 10 to also be used with two webbings. To this end, further slots 60, 62, 64, 66 can be provided on both end portions 18, 20 of the main body 12, with the aid of which two webbings can be assembled so as to be mutually parallel on the main body 12 (see FIG. 3). The assembly of the two webbings here preferably takes place in the manner already mentioned above in the context of the webbing 14.

It is understood that the shown embodiment represents only one of many potential embodiments of the presented slackline device. Modifications in terms of size and shape are readily possible without departing from the spirit and scope of the present disclosure.

FIGS. 7*a*-7*d* show, for example, various dissimilar longitudinal sectional profiles of the main body 12 in order to highlight that the latter can also be configured in many variants. In a manner similar to a snowboard, the main body 12, which is configured as a board, in the longitudinal section thereof can have, for example, a rocker shape, a cambered shape, or else a concave-convex shape. Combinations of these shapes are also conceivable in principle.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

What is claimed is:

1. A slackline device, comprising:

a main body having at least two bearing portions with an upward bowed portion therebetweens, the at least two bearing portions configured to bear on the ground to support the slackline device, and two mutually opposite end portions which are disposed so as to be elevated in relation to the at least two bearing portions; and a webbing which in an assembled state of the slackline device is tensioned between the two end portions of the main body, wherein the main body is configured to be more elastic than the webbing.

2. The slackline device as claimed in claim 1, wherein the main body is configured such that the main body deforms more than the webbing when the webbing is loaded.

3. The slackline device as claimed in claim 1, wherein an elasticity modulus of the webbing is at least two times higher than an elasticity modulus of the main body.

4. The slackline device as claimed in claim 1, wherein the main body is configured as a board.

5. The slackline device as claimed in claim 1, wherein the at least two bearing portions are disposed between the two end portions and are integrally connected thereto.

6. The slackline device as claimed in claim 1, wherein the two end portions are each configured as ends or tips of the main body that are curved upward in relation to the at least two bearing portions.

7. The slackline device as claimed in claim 1, wherein a distance between the two end portions is smaller than 2.5 meters.

8. The slackline device as claimed in claim 1, wherein a width of the main body is smaller than a distance, measured orthogonally to said width, between the two end portions.

9. A method of using the slackline device as claimed in claim 1, comprising:

providing the slackline device in an unloaded state with a first distance between the two end portions;

providing the slackline device in a loaded state with the at least two bearing portions bearing on the ground to support the slackline device, and a second distance between the two end portions that is different than the first distance between the two end portions when the slackline device is in an unloaded state.

10. The slackline device as claimed in claim 1, wherein the main body in a longitudinal section is curved and/or angled upwardly and includes a concave-convex profile, a rocker profile and/or a cambered profile.

11. A slackline device, comprising:

a main body in a longitudinal section having at least two bearing portions with an upward bowed portion therebetweens, the at least two bearing portions configured to bear on the ground to support the slackline device, and two mutually opposite end portions which are disposed so as to be elevated in relation to the at least two bearing portions; and a webbing which in an assembled state of the slackline device extends over the two end portions of the main body so as to form a tensioned portion between the two end portions.

12. The slackline device as claimed in claim 11, wherein a first one of the two end portions comprises a first planar wall portion having a first slot penetrating the main body, the webbing in the assembled state of the slackline device being guided through said first slot by way of a first loop formed by folding back a first end of the webbing, wherein a first locking element is guided through the first loop, said first locking element comprising to mutually opposite end pieces that bear on the first planar wall portion on opposite sides of the first slot, a second loop is fixedly disposed on the first end of the webbing, said second loop in the assembled state of the slackline device not being guided through the first slot and being disposed between the webbing and the main body.

13. The slackline device as claimed in claim 12, wherein the first locking element comprises a centerpiece which has a cylindrical shape and is disposed between the two end pieces each of which has a cylindrical shape and a diameter that is enlarged in relation to a diameter of the centerpiece.

14. The slackline device as claimed in claim 12, wherein a second one of the two end portions comprises a second planar wall portion having a second slot penetrating the main body, the webbing in the assembled state of the slackline device being guided through said second slot by way of a third loop which is fixedly disposed on a second end of the webbing, wherein a securing element is guided through the third loop.

15. The slackline device as claimed in claim 11, wherein the main body is configured to be more elastic than the webbing.

16. The slackline device as claimed in claim 11, wherein the main body is configured as a board.

17. The slackline device as claimed in claim 11, wherein the at least two bearing portions are disposed between the two end portions and are integrally connected thereto.

18. The slackline device as claimed in claim 11, wherein the two end portions are each configured as ends or tips of the main body that are curved upward in relation to the at least two bearing portions are, and the webbing extends on and over the ends or tips.

19. The slackline device as claimed in claim 11, wherein the main body in the longitudinal section has at least a section with a cambered profile.

20. A method of using the slackline device as claimed in claim 11, comprising:

providing the slackline device in an unloaded state with a first distance between the two end portions;

providing the slackline device in a loaded state with the at least two bearing portions bearing on the ground to support the slackline device, and a second distance between the two end portions that is different than the first distance between the two end portions when the slackline device is in an unloaded state.

* * * * *